US009366167B2

(12) United States Patent
McFarland

(10) Patent No.: US 9,366,167 B2
(45) Date of Patent: Jun. 14, 2016

(54) INJECTOR WATER INTRUSION SEAL WITH BLOW OUT VOLUME

(71) Applicant: Continental Automotive Systems, Inc., Auburn Hills, MI (US)

(72) Inventor: Robert W. McFarland, Smithfield, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 13 days.

(21) Appl. No.: 14/509,216

(22) Filed: Oct. 8, 2014

(65) Prior Publication Data

US 2015/0129679 A1 May 14, 2015

Related U.S. Application Data

(60) Provisional application No. 61/901,504, filed on Nov. 8, 2013.

(51) Int. Cl.

| | |
|---|---|
| ***F02M 55/00*** | (2006.01) |
| ***F02M 61/16*** | (2006.01) |
| ***F02M 65/00*** | (2006.01) |
| ***F01N 3/20*** | (2006.01) |

(52) U.S. Cl.

CPC ..... *F01N 3/2066* (2013.01); *F02M 55/005* (2013.01); *F02M 61/168* (2013.01); *F02M 65/006* (2013.01); *F01N 2610/02* (2013.01); *F01N 2610/1453* (2013.01); *F02M 2200/16* (2013.01); *Y10T 29/494* (2015.01)

(58) Field of Classification Search

CPC . F02M 55/005; F02M 61/168; F02M 65/006; F02M 2200/16; F01N 3/2066; F01N 2610/02; F01N 2610/1453; Y10T 29/494; F16L 21/02; F16L 21/03; F16L 21/035; F16L 21/05

See application file for complete search history.

(56) References Cited

U.S. PATENT DOCUMENTS 7,398,767 B2 * 7/2008 Kondo ..... F02M 61/145 123/468
2005/0284449 A1 * 12/2005 Zdroik ..... F02M 25/08 123/516

(Continued)

FOREIGN PATENT DOCUMENTS

DE 1020070300003 A1 1/2009
JP 2012517553 A 8/2012

(Continued)

OTHER PUBLICATIONS

EP Search Report, European Patent Application 14 189 320.6, dated May 21, 2015.

*Primary Examiner* — Darren W Gorman

(57) ABSTRACT

A fluid injector includes a housing and an inlet tube having a portion received in the housing. A primary seal creates a seal between surfaces of the housing, the inlet tube, and an inlet of the injector. A groove is in the housing and a secondary seal is in the groove to defining a seal between the housing and a portion of the inlet of the injector. A recessed portion is defined in the housing and is in communication with the groove. The recessed portion defines a blow-out volume such that when the primary seal is leak tested, an indication of a leak of the primary seal can be detected when the pressurized air moves past the primary seal and forces a portion of the secondary seal to an unsealed position into the blow-out volume.

9 Claims, 5 Drawing Sheets

(56) References Cited

U.S. PATENT DOCUMENTS

| | | | | |
|---|---|---|---|---|
| 2009/0107126 | A1* | 4/2009 | Bugos | F01N 3/2066 60/301 |
| 2010/0314470 | A1 | 12/2010 | Cavanagh | |
| 2012/0037727 | A1 | 2/2012 | Reiter | |
| 2013/0233279 | A1* | 9/2013 | Karay | F02M 21/0266 123/470 |

FOREIGN PATENT DOCUMENTS

| | | | |
|---|---|---|---|
| JP | 2013100740 | A | 5/2013 |
| WO | 2012000038 | A2 | 1/2012 |
| WO | 2012049175 | A1 | 4/2012 |
| WO | 2013039870 | A1 | 3/2013 |
| WO | 2013083522 | A1 | 6/2013 |

* cited by examiner

INJECTOR WATER INTRUSION SEAL WITH BLOW OUT VOLUME

This application claims priority from U.S. Provisional Patent Application No. 61/901,504, filed on Nov. 8, 2013, the content of which is hereby incorporated by reference into this specification.

FIELD

The invention relates generally to a secondary seal used for preventing liquid from entering an injector, and in more particular, to blow-out volume that can receive a portion of a secondary seal.

BACKGROUND

With reference to FIGS. 1 and 2, a fluid injector, generally indicated at 10, for use as a Reductant Delivery Unit (RDU) in a Selective Catalytic Reduction (SCR) system includes a primary O-ring 12 to seal urea being introduced into the injector 10 and to prevent liquid (e.g., water) ingress into the interior 16 of the injector 10. Even with the primary seal 12, as shown by the arrows in FIG. 2, water can ingress through the injector shield 14 and migrate below the primary O-ring 12 and enter the interior 16 of the injector 10 (between housing 26 and inlet tube 30). Such water ingress below the primary O-ring 12 can cause corrosion and or electrical short circuiting.

With reference to FIG. 3, Applicant added a secondary seal or O-ring 18 to eliminate water intrusion that may migrate below the primary O-ring 12. However, the secondary seal was found to prevent effective testing of the primary O-ring 12. Failure of the primary O-ring 12 would force AUS32 (urea, indicated by arrows in FIG. 3) into the interior 16 of the injector 10, leading to premature injector failure.

Accordingly, there exists a need in an injector a secondary seal to prevent ingress of liquid into the injector, while also allowing effective testing of the primary seal.

SUMMARY

An objective of the invention is to fulfill the need referred to above. In accordance with the principles of an embodiment, this objective is obtained by providing a fluid injector that includes a housing and an inlet tube having a portion received in the housing. The inlet tube has an opened end for receiving fluid from an inlet of the injector. A primary seal is disposed about a portion of the inlet tube so as to create a seal between surfaces of the housing, the inlet tube, and the inlet of the injector. A groove is defined in a periphery of the housing and a secondary seal is disposed in the groove and defining a seal between the housing and a portion of the inlet of the injector. A recessed portion is defined in the housing and is in communication with the groove so that due to the recessed portion, an entirety of the secondary seal is not supported by the groove. The recessed portion defines a blow-out volume such that when the primary seal is leak tested by forcing pressurized air through the inlet of the injector, an indication of a leak of the primary seal can be detected when the pressurized air moves past the primary seal and forces a portion of the secondary seal to an unsealed position into the blow-out volume.

In accordance with another aspect of an embodiment, a method seals a fluid injector. The injector includes a housing and an inlet tube having a portion received in the housing. The inlet tube has an opened end for receiving fluid from an inlet of the injector. The method provides a primary seal disposed about a portion of the inlet tube so as to create a first seal between surfaces of the housing, the inlet tube, and the inlet of the injector. A secondary seal defines a second seal between the housing and a portion of the inlet of the injector. When the primary seal is leak tested by forcing pressurized air through the inlet of the injector causing the pressurized air to move past the primary seal, the method ensures that the second seal can be forced by the pressurized air into an unsealed position, thereby indicating a leak of the primary seal.

Other objective, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXEMPLARY EMBODIMENTS

The following description of the preferred embodiment(s) is merely exemplary in nature and is in no way intended to limit the invention, its application, or uses.

Figure 1:
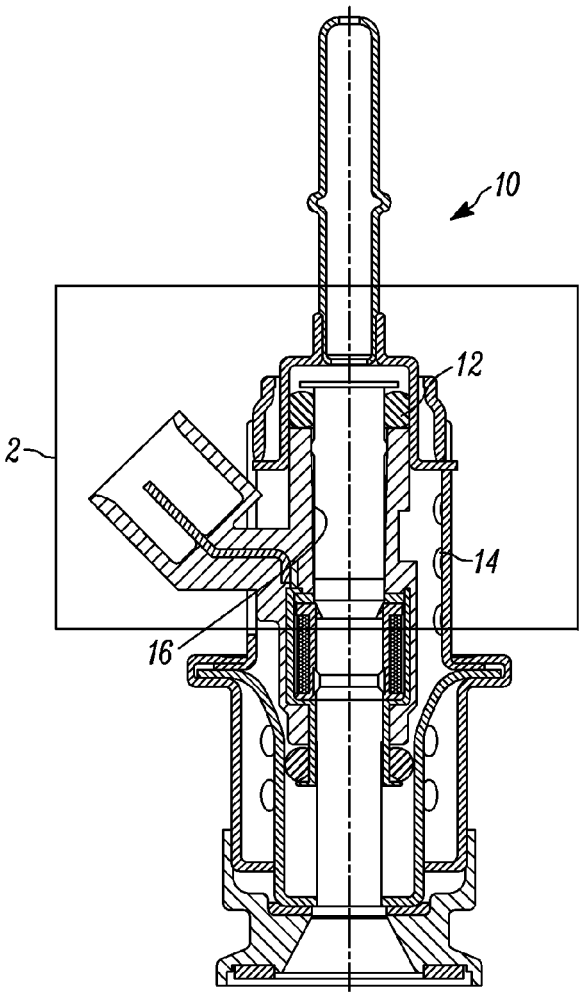
(PRIOR ART) FIG. 1
FIG. 1 cross-sectional view of a conventional fluid injector having a primary O-ring to prevent liquid ingress.
Figure 2:
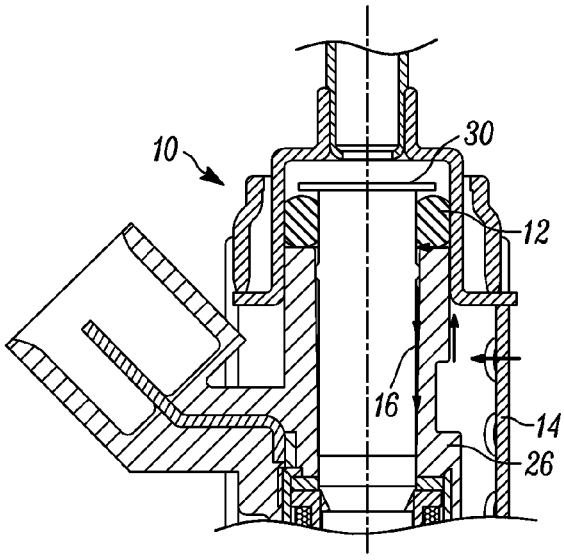
(PRIOR ART) FIG. 2
FIG. 2 is an enlarged view of the enclosed portion 2 of FIG. 1.
Figure 3:
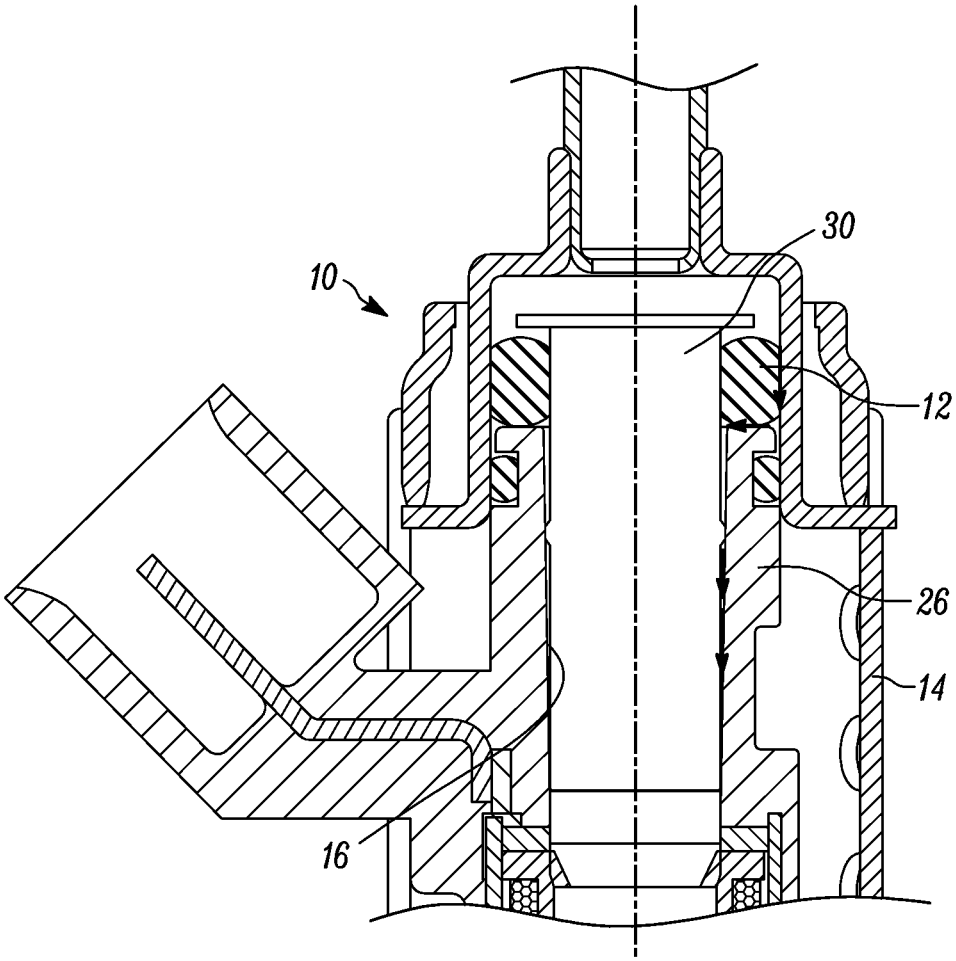
FIG. 3 is an enlarged sectional view showing a secondary O-ring provided in the injector of FIG. 1.
Figure 4:
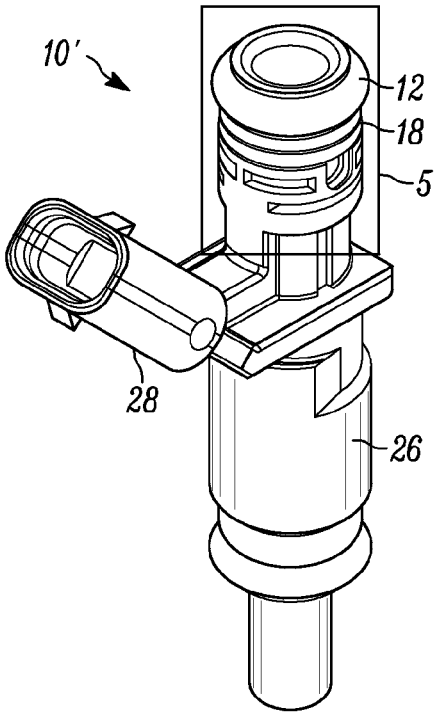
FIG. 4 is perspective view of a fluid injector having a primary seal, a secondary seal and a blow-out volume in accordance with an embodiment, and shown with an inlet cup assembly and shield removed.
Figure 6:
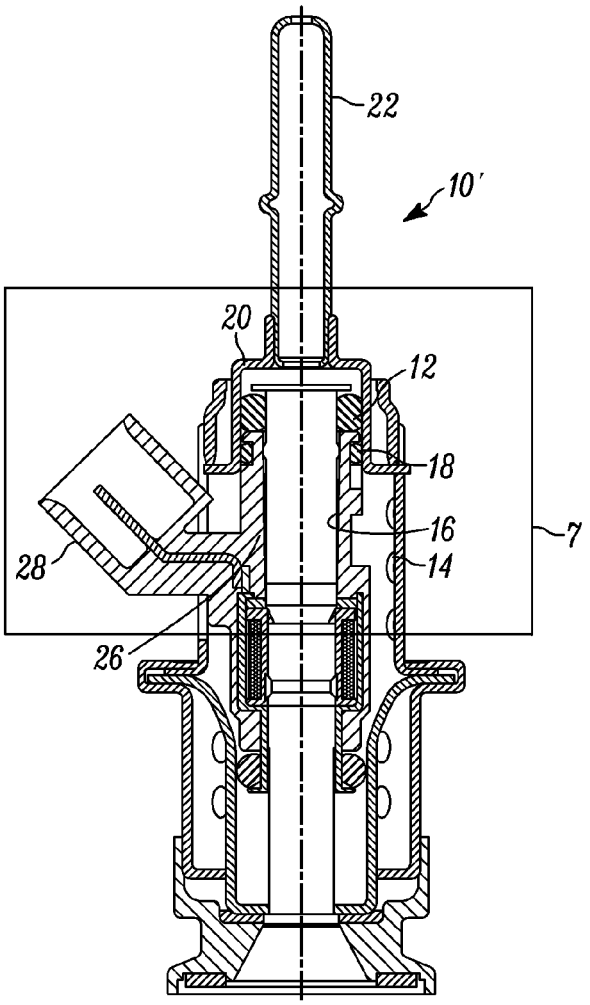
FIG. 6 is a cross-sectional view of the injector of FIG. 4 with the secondary seal functioning normally.
Figure 7:
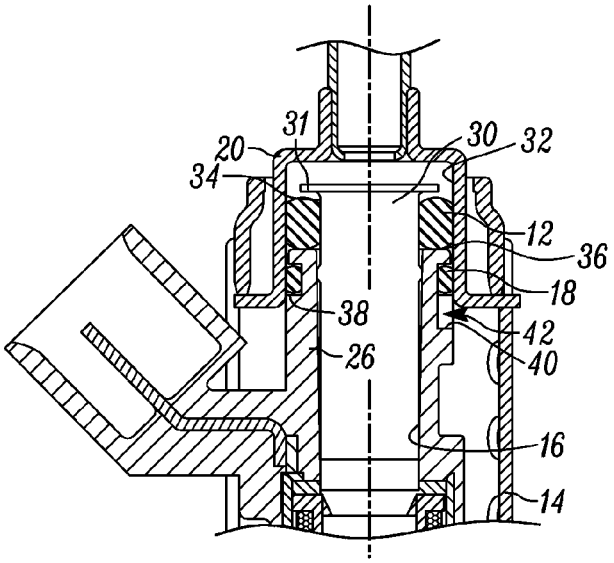
FIG. 7 is an enlarged view of the enclosed portion 7 of FIG. 6.

With reference to FIGS. 4 and 6 a fluid injector is shown, generally indicated at 10', in accordance with an embodiment. The injector 10' is constructed and arranged as a Reductant Delivery Unit (RDU) for use in a Selective Catalytic Reduction (SCR) system. As shown FIG. 6, the injector 10' includes an inlet cup assembly having an inlet cup 20 coupled to a cup tube 22 defining an inlet of the injector 10'. The cup tube 22 is constructed and arranged to be connected to a source of fluid such as urea for introduction into the injector 10'. The inlet cup 20 is connected to a shield 14, and the shield 24 substantially surrounds a housing 26, which includes an electrical connector 28. FIG. 4 does not show the inlet cup assembly or the shield 14 so that components there-under can be seen clearly.

A portion of an inlet tube 30 is disposed within the housing 26. The inlet tube 30 has an open end 31 for receiving fluid from the inlet cup assembly (injector inlet) that will be ejected from the injector 10'. A primary seal such as an elastomer O-ring 12 is disposed about a periphery of an upper portion of the cylindrical inlet tube 30 adjacent to the housing 26 to prevent liquid (e.g., water) ingress into the interior 16 of the injector 10'. The primary seal 12 also seals urea from migrating past the inlet cup 20 and between the housing 26 and the inlet tube 30. The primary seal 12 thus provides a seal between the inner surface 32 of the inlet cup 20, an outer surface 34 of the inlet tube 30 and an upper surface 36 of the housing 26. A secondary seal 18 such as an elastomer O-ring is disposed in an annular groove 38 formed in a periphery of the housing 26, generally adjacent to the primary seal 12. The secondary seal 18 defines a seal between the housing 26 and the inlet cup 20 that prevents water leakage into the interior 16 that may enter through the shield 14. Also formed as part of the housing 26 and in communication with the groove 38 is a recessed portion 40 defining blow-out volume, generally indicated at 42. The recessed portion 40 extends axially from the groove 38. Thus, due to the recessed portion 40, the groove 38 extends less than 360° about the periphery of the housing 26, leaving a small portion of the secondary seal 18 unsupported. The recess portion 40 can be molded into the groove 38 upon molding the housing 26. The function of the blow-out volume 42 will be explained below.

Figure 8:
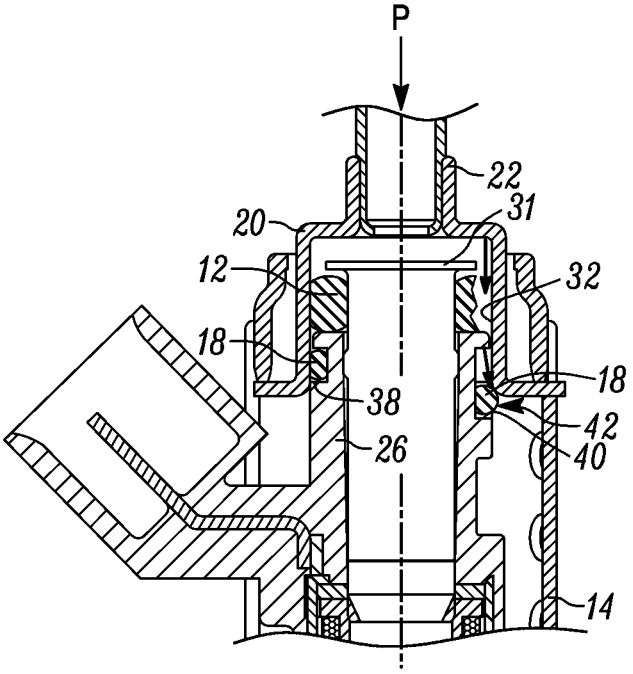
FIG. 8 is view of the portion of the injector of FIG. 7, but shown after the primary seal has failed with the secondary seal being extruded into the blow-out volume during primary seal testing.

With reference to FIG. 8, during the assembly process of the injector 10', the primary seal 12 is tested to make sure it is functioning properly. To test the primary seal 12, pressurized air P is forced into the cup tube 22 (the lower end of the injector 10 is also sealed to allow pressure to build inside the injector 10), such that the primary seal 12 is exposed to the pressurized air. If the primary seal 12 is damaged or is functioning improperly, the pressurized air moves past by the primary seal 12, and the secondary seal 18 is then exposed to the pressurized air, causing a portion of the secondary seal 18 to move to an unsealed position by extruding into the blow-out volume 42 of the recessed portion 40. Thus, since the secondary seal 18 moves to an unsealed area, a leak due to a faulty primary seal 12 can be detected. The secondary seal 18 must be flexible enough to extrude into the blow-out volume 42, but be firm enough to remain in position during assembly and during normal use.

In the embodiment, the recessed portion 38 is generally U-shaped, and has a maximum width W of 3.0 mm. However, it is within the scope of the invention that other shapes and widths may be used.

Figure 5:
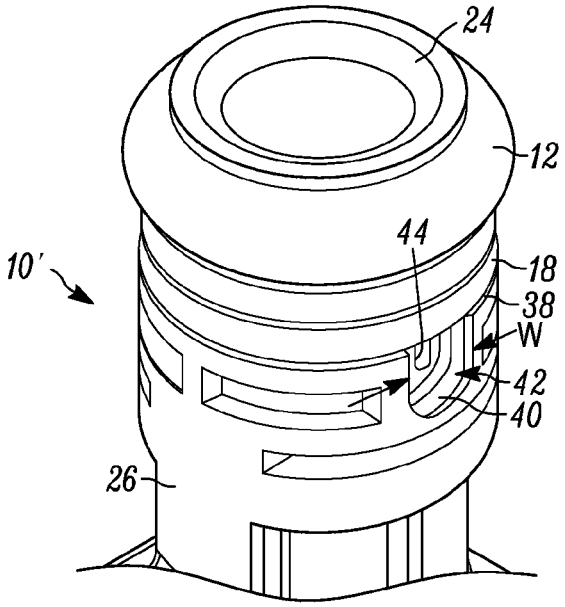
FIG. 5 is an enlarged view of the enclosed portion 5 of FIG. 4.
Figure 9:
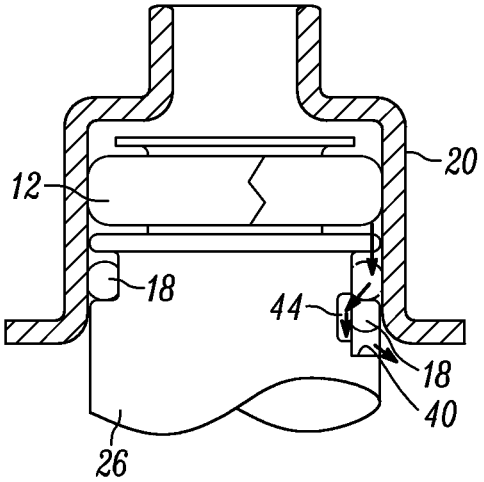
FIG. 9 is a view of the groove in the blow-out volume of the injector of FIG. 5, showing an air escape path through the groove and around the secondary seal.

With reference to FIG. 5, a small groove 44 is in communication with the recessed portion 40 and the blow-out volume 42. The groove permits the secondary seal 18 to move less before releasing any pressure during leak testing. This groove 44 is necessary if the injector 10' is inserted deep into the inlet cup 20 since the secondary seal 18 would not blow-out, giving false leak measurements. The arrows in FIG. 9 show an air path around the secondary seal 18 using the groove 44 when the secondary seal 18 moves to an unsealed position upon testing the primary seal 12.

Thus, the secondary seal 18 provides further sealing of the interior 16 of the injector 10' in the event water gets past the primary seal 12. The blow-out volume 42, receiving a portion of the secondary seal 18, allows the primary seal 12 to be leak tested thereby ensuring the integrity of the primary seal 12 and preventing urea from entering into the interior 16 of the injector 10'.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fluid injector comprising:

a housing;

an inlet tube having a portion received in the housing, the inlet tube having an opened end for receiving fluid from an inlet defined by an inlet cup assembly of the injector;

a primary seal disposed about a portion of the inlet tube so as to create a seal between surfaces of the housing, the inlet tube, and the inlet cup assembly of the injector;

a groove defined in a periphery of the housing;

a secondary seal disposed in the groove and defining a seal between the housing and a portion of the inlet cup assembly of the injector; and a recessed portion defined in the housing and in communication with the groove so that due to the recessed portion, an entirety of the secondary seal is not supported by the groove, wherein the recessed portion defines a blow-out volume such that when the primary seal is leak tested by forcing pressurized air through the inlet of the injector, an indication of a leak of the primary seal can be detected when the pressurized air moves past the primary seal and forces a portion of the secondary seal to move to an unsealed position into the blow-out volume.

2. The injector of claim 1, wherein the recessed portion is substantially U-shaped and extends axially from the groove.

3. The injector of claim 2, wherein the recessed portion has a maximum width of about 3.0 mm.

4. The injector of claim 1, wherein the groove is generally annular and the secondary seal is an elastomer O-ring.

5. The injector of claim 1, wherein the primary seal is an elastomer O-ring.

6. The injector of claim 1, wherein the secondary seal is adjacent to the primary seal.

7. The injector of claim 1, further comprising a shield connected to the inlet cup assembly and surrounding a portion of the housing.

8. The injector of claim 1, wherein the injector is a Reductant Delivery Unit in a Selective Catalytic Reduction system and the primary seal is constructed arranged to seal urea from migrating past the inlet cup assembly and between the housing and the inlet tube and the secondary seal is constructed and arranged to seal liquid from migrating past the inlet cup assembly and between the housing and the inlet tube.

9. The injector of claim 1, further comprising a groove in communication with the recessed portion and constructed and arranged to permit air to move around the secondary seal when the secondary seal moves to the unsealed position during leak testing of the primary seal.

* * * * *